US005456997A

United States Patent [19]

Moriyama et al.

[11] Patent Number: 5,456,997

[45] Date of Patent: Oct. 10, 1995

[54] ELECTROPHOTOGRAPHIC PHOTORECEPTOR

[75] Inventors: Hiroaki Moriyama; Kohichi Yamamoto; Ryosaku Igarashi; Shigetoshi Nakamura; Tomoo Kobayashi, all of Kanagawa, Japan

[73] Assignee: Fuji Xerox Co., Ltd., Tokyo, Japan

[21] Appl. No.: 68,072

[22] Filed: May 28, 1993

Related U.S. Application Data

[63] Continuation of Ser. No. 757,900, Sep. 11, 1991, abandoned.

[30] Foreign Application Priority Data

Oct. 26, 1990 [JP] Japan ..... 2-287230

[51] Int. Cl.[6] ..... G03G 5/05

[52] U.S. Cl. ..... 430/58; 430/96

[58] Field of Search ..... 430/58, 84, 88, 430/87, 90, 91, 75, 78, 85, 86, 96

[56] References Cited

U.S. PATENT DOCUMENTS 4,725,519 2/1988 Suzuki et al. ..... 430/58
4,749,637 6/1988 Hayashida et al. ..... 430/58
4,780,385 10/1988 Wieloch et al. ..... 430/58
5,001,029 3/1991 Kato et al. ..... 430/49

FOREIGN PATENT DOCUMENTS 0102243 6/1985 Japan .
1282560 11/1989 Japan .

*Primary Examiner*—Christopher D. Rodee
*Attorney, Agent, or Firm*—Finnegan, Henderson, Farabow, Garrett & Dunner

[57] ABSTRACT

An electrophotographic photoreceptor showing no reduction in charge property and no increase in residual potential when repeatedly used under the circumstances of high temperature and humidity for a long time and exhibiting excellent environmental stability, which comprises an electrically conductive substrate having thereon at least a charge generating layer and a charge transporting layer, wherein a binder contained in said charge generating layer comprises at least one organic metal compound selected from the group consisting of organic metal alkoxides and organic metal chelate compounds.

2 Claims, 1 Drawing Sheet

ELECTROPHOTOGRAPHIC PHOTORECEPTOR

This application is a continuation of application Ser. No. 07/757,900, filed Sep. 11, 1991, now abandoned.

FIELD OF THE INVENTION

This invention relates to a function separation type electrophotographic photoreceptor comprising an electrically conductive substrate and at least a charge generating layer and a charge transporting layer formed thereon, and more particularly to an electrophotographic photoreceptor comprising a charge generating layer including a novel binder.

BACKGROUND OF THE INVENTION

Conventionally, various materials have been proposed and used for photosensitive layers of electrophotographic photoreceptors. One of them is an inorganic material such as selenium, zinc oxide or cadmium sulfide, and another is an organic material. As so-called organic photoreceptors using organic materials, ones in which materials excellent in charge generating ability and materials excellent in charge transporting ability are used in combination, namely function separation type photoreceptors, occupy the main current rather than ones having a single layer structure. The function separation type photoreceptors have the advantage that the selection range of materials used for the photosensitive layers is expanded, thereby being excellent in electrophotographic characteristics such as charging property and sensitivity. The charge generating materials used for charge generating layers include bisazo pigments, phthalocyanine pigments, pyrylium pigments, perylene pigments, polycyclic quinone pigments, quinacridone pigments and indigo pigments. Further, the charge transporting materials used for charge transporting layers include pyrazoline, hydrazones and polyvinylcarbazole.

The charge generating layers are sometimes formed by using the charge generating materials alone, but binder resins are generally used in combination therewith. As the binder resins used for the charge generating layers, materials are generally selected for use which have properties as coatings such as dispersibility to the charge generating materials, stability of dispersions, adhesion to electrically conductive layers or undercoating layers, and dissolution resistance and penetration resistance to organic solvents contained in the charge transporting layers, as well as electrophotographic characteristics such as sensitivity, charging property and repetitive characteristics. Examples of the binder resins conventionally used include polycarbonates, polystyrene, polyesters, polyvinyl butyral, vinyl acetate polymers or copolymers, polyurethanes and epoxy resins.

However, the binder resins conventionally used have the disadvantage that the charge blocking is liable to take place due to their high water absorption when they are repeatedly used under the condition of high temperature and humidity for a long time, which causes a reduction in charging property and an increase in residual potential. Accordingly, the appearance of a binder which does not produce such a disadvantage has been desired.

SUMMARY OF THE INVENTION

The present invention has been made under such circumstances.

An object of the present invention is therefore to provide an electrophotographic photoreceptor which exhibits practical sensitivity and stable electrophotographic characteristics when repeatedly used, by using a novel binder.

The above objects of the present invention are achieved by providing an electrophotographic photoreceptor comprising an electrically conductive substrate having thereon at least a charge generating layer and a charge transporting layer, wherein a binder contained in said charge generating layer comprises at least one organic metal compound selected from the group consisting of organic metal alkoxides and organic metal chelate compounds.

DETAILED DESCRIPTION OF THE INVENTION

The present invention will hereinafter be described in detail.

Figure 1:
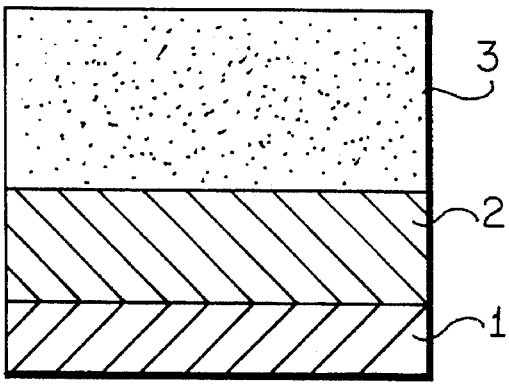
FIGS. 1 to 4 are schematic cross sectional views showing electrophotographic photoreceptors of the present invention.
Figure 2:
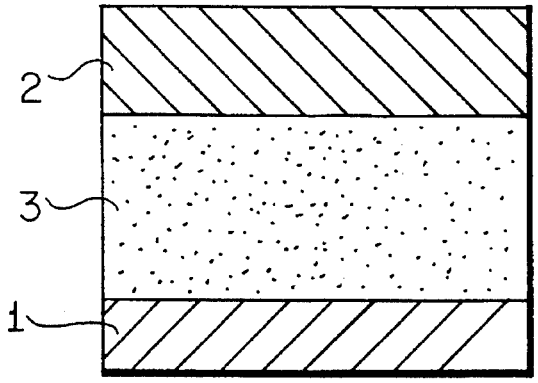
Figure 3:
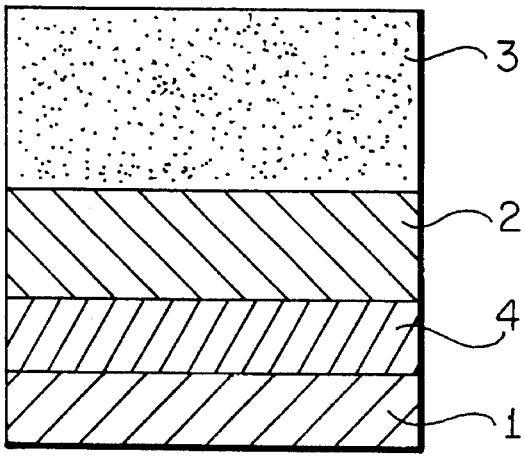
Figure 4:
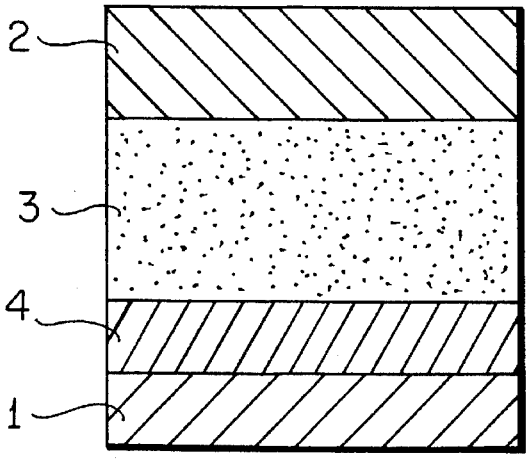

FIGS. 1 to 4 are schematic cross sectional views showing electrophotographic photoreceptors of the present invention, respectively. Referring to FIG. 1, an electrically conductive substrate 1 is laminated with a charge generating layer 2 and a charge transporting layer 3 in this order, and referring to FIG. 2, the electrically conductive substrate 1 is laminated with the charge transporting layer 3 and the charge generating layer 2 in this order. Further, referring to FIGS. 3 and 4, an undercoating layer 4 is formed between the electrically conductive substrate 1 and the charge generating layer 2 or the charge transporting layer 3.

The electrically conductive substrate used in the present invention include, for example, metal pipes, metal plates, metal sheets, metal foil, polymer films subjected to electrically conductive treatment, polymer films having deposited layers of metals such as Al, and polymer films or paper sheets covered with metal oxides such as $SnO_2$ or with quaternary ammonium salts.

The charge generating layer and the charge transporting layer are formed on the electrically conductive substrate. Their order of lamination is arbitrary, but it is preferred that the charge transporting layer is formed as an upper layer.

The charge generating layers comprise the charge generating materials and binders.

The charge generating materials which can be used include inorganic semiconductors such as trigonal selenium, organic semiconductors such as polyvinylcarbazole, and organic pigments such as bisazo compounds, trisazo compounds, phthalocyanine compounds, pyrylium compounds and squarylium compounds.

In the present invention, each of the binder for these charge generating materials is formed by using at least one organic metal compound selected from the group consisting of organic metal alkoxides and organic metal chelate compounds. Metal atoms contained in these organic metal compounds are preferably selected from Si, Sn, Ti and Zr.

Specific examples of the organic metal alkoxides and the organic metal chelate compounds which can be used in the present invention include, but are not limited to, $Zr(OC_3H_7)_4$, $Zr(OC_4H_9)_4$, $Ti(OC_3H_7)_4$, $Ti(OC_4H_9)_4$, $Si(OCH_3)_4$, $Si(OC_3H_7)_4$, $Sn(OCH_3)_4$ and $Sn(OC_4H_9)_4$ as an organic metal alkoxides (i.e., a compound having a $C_nH_{2n+1}O$-group); $Zr(C_5H_7O_2)_4$, $(C_5H_7O_2)Zr(OC_4H_9)_3$ and $(C_3H_7O)_2Ti(C_5H_7O_2)_2$ as an organic metal chelate compounds (i.e., a compound having a ring structure in which a metal is sandwiched by coordination atoms). Among these, the organic metal alkoxide is preferred since it has a good stability.

When the above-described organic metal alkoxides or organic metal chelate compounds are used as the binders, known binder resins may be used in combination therewith to improve film-forming property. Such binder resins include, for example, polystyrene, silicone resins, polycarbonate resins, acrylic resins, methacrylic resins, polyester resins, vinyl polymers, cellulose resins and alkyd resins.

The charge generating layers can be formed by applying a coating solution prepared by mixing the above-described charge generating materials and the above-described organic metal alkoxides or organic metal chelate compounds, and the binder resins as so desired, according to conventional methods. Dispersion stabilizing agents may be added to the coating solutions to improve dispersibility.

The charge generating layers are generally formed so as to give a thickness of 0.1 to 10 μm (preferably 0.1 to 5 μm).

The charge transporting layers are formed by the charge transporting materials and the binder resins if desired.

For example, there can be used film-forming binder resins containing hydrazone derivatives such as N-methyl-N-phenylhydrazino- 3-methylidene-9-ethylcarbazole, p-diethylaminobenzaldehyde-N,N-diphenylhydrazone, and p-diethylaminobenzaldehyde-N-α-naphthyl-N-phenylhydrazone; pyrazoline derivatives such as 1-phenyl-3-(p-diethylaminostyryl)- 5-(p-diethylaminophenyl)pyrazoline and 1-[quinolyl(2)]-3-(p-diethylaminostyryl)-5-(p-diethylaminophenyl)pyrazoline; oxazole compounds such as 2-(p-diethylaminostyryl)- 6-diethylaminobenzoxazole; triarylmethane compounds such as bis(4-diethylamino-2-methylphenyl)phenylmethane; and diamine compounds such as N,N'-bis-N,N'-(m-tolyl)-[1,1'biphenyl]-4,4'-diamine, or photoconductive polymers such as poly-N-vinylcarbazole and polyvinylanthracene.

The film thickness of the charge transporting layers is generally within the range of 5 to 50 μm (preferably 10 to 30 μm).

In the electrophotographic photoreceptors of the present invention, the undercoating layer may be formed on the electrically conductive substrate. The undercoating layer is effective to prevent blocking of unnecessary charges supplied from the conductive substrate or to improve adhesive property, and have the function of improving image quality. Materials constituting the undercoating layer include metal oxides such as aluminum oxide, organic metal compounds and resins such as acrylic resins, phenol resins, polyester resins and polyurethane resins.

In the present invention, when at least one organic metal compound selected from the group consisting of the organic metal alkoxides and the organic metal chelate compounds is used as a component of the binder contained in the charge generating layer, potential characteristics of the electrophotographic photoreceptor are improved. Although that reason is not apparent, it is assumed that the charge generating layers are difficult to be affected by the circumstances, particularly by humidity, because these organic metal compounds are generally low in volume resistivity, so that the accumulation of charges is difficult to take place, and because the charge generating layers are formed in the reaction course of condensation by hydrolysis.

The present invention will be described with reference to the following examples and comparative examples.

EXAMPLES

EXAMPLE 1

An aluminum pipe was used as an electrically conductive substrate. The pipe was coated with a coating solution composed of 10 parts by weight (hereinafter abbreviated as "parts") of a polyamide resin, 150 parts of methanol and 40 parts of butanol, using a draw coating method, and the solution was dried to form an undercoating layer having a thickness of 1 μm.

Then, a mixture composed of 10 parts of an organic metal compound represented by the following structural formula (I), 90 parts of trigonal selenium and 300 parts of n-butanol was dispersed by the use of an attritor, and 2 parts of 1-butanol was added to 1 part of the resulting dispersion to dilute. The thus-diluted dispersion was coated on the undercoating layer by the draw coating method, and dried to form an charge generating layer having a thickness of 0.2 μm.

(I)

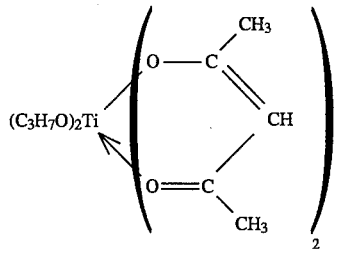

Then, 4 parts of N,N'-diphenyl-N,N'-bis(3-methylphenyl)-[ 1,1'-biphenyl]-4,4'-diamine and 6 parts of a polycarbonate resin [bisphenol Z type: PC(Z)] were dissolved in 90 parts of monochlorobenzene to obtain a coating solution. The resulting solution was coated on the above-described charge generating layer, using the draw coating method, followed by drying at 170° C. for 90 minutes to form a charge transporting layer having a thickness of 13 μm.

For the electrophotographic photoreceptor thus obtained, various electrophotographic characteristics were evaluated. Namely, the photoreceptor was charged so that the electric current which flowed into the photoreceptor reached −10 μA, and 1 second after charging, the surface potential of the photoreceptor was measured. The value obtained was defined as VDDP. Then, the charges were removed by a tungsten lamp, and the potential after charge elimination was measured. This potential was adjusted so that the residual potential VRP reached −500 V, and 0.3 second after charging, the photoreceptor was exposed to monochromatic light having a wavelength of 650 nm while changing the quantity of light. The quantity of light at which the potential reached −250 V, 0.7 second after exposure (1 second after charging) was determined, and defined as photosensitivity E1/2. Charging, exposure and charge elimination were repeated 1,000 cycles, and then, similar evaluations were carried out. The results are shown in Table 1.

EXAMPLE 2

An undercoating layer was formed similarly with Example 1. Then, a mixture composed of 9 parts of $Si(OCH_3)_4$, 1 part of a polyvinyl butyral resin ("BX-1", manufactured by Sekisui Chemical Co., Ltd.), 90 parts of trigonal selenium and 300 parts of n-butanol was dispersed by the use of an attritor, and 2 parts of n-butanol was added to 1 part of the resulting dispersion to dilute. The thus-diluted dispersion was coated on the undercoating layer by the draw coating method, and dried to form a charge generating layer having a thickness of 0.2 μm. Then, a charge transporting layer was formed in the same manner as in Example 1. For the resulting electrophotographic photoreceptor, the electrophotographic characteristics were evaluated in the same manner as in Example 1. The thus-obtained results obtained are shown in Table 1.

EXAMPLE 3

An aluminum pipe was coated with a coating solution composed of 2 parts of an organic metal compounds represented by formula (II), 1 part of a silane coupling agent represented by formula (III) and 40 parts of n-butanol, and the obtained solution was dried to form an undercoating layer having a thickness of 0.1 μm. Then, a mixture composed of 9 parts of the compound represented by the above formula (I), 1 part of a polyvinyl butyral resin ("BMS", manufactured by Sekisui Chemical Co., Ltd.), 90 parts of trigonal selenium and 300 parts of n-butanol was dispersed by the use of an attritor, and 2 parts of n-butanol was added to 1 part of the resulting dispersion to dilute.

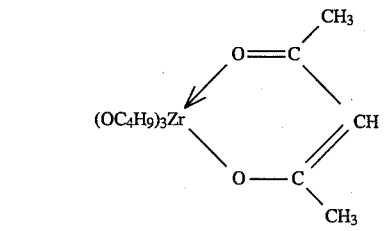

(II)

$H_2NC_3H_6-Si(OCH_3)_3$ (III)

The thus-diluted dispersion was coated on the undercoating by the draw coating method, and dried to form a charge generating layer having a thickness of 0.3 μm. Then, a charge transporting layer was formed in the same manner as in Example 1. For the resulting electrophotographic photoreceptor, the electrophotographic characteristics were evaluated in the same manner as in Example 1. The thus-obtained results are shown in Table 1.

COMPARATIVE EXAMPLE 1

An electrophotographic photoreceptor was prepared in the same manner as in Example 2 except that $Si(OCH_3)_4$ was not used, and evaluated in the same manner as in Example 2. Thus-obtained results are shown in Table 1.

TABLE 1

| | Initial | | | After 1,000 Cycles | | |
|---|---|---|---|---|---|---|
| | VDDP (V) | VRP (V) | E1/2 (erg/cm$^2$) | VDDP (V) | VRP (V) | E1/2 (erg/cm$^2$) |
| Example 1 | −510 | −15 | 0.9 | −490 | −25 | 1.1 |
| Example 2 | −530 | −20 | 0.9 | −495 | −35 | 1.2 |
| Example 3 | −490 | −20 | 1.0 | −465 | −30 | 1.5 |
| Comparative Example 1 | −490 | −20 | 1.2 | −400 | −80 | 2.1 |

EXAMPLE 4

An undercoating layer was formed on an aluminum pipe in the same manner as in Example 1.

Then, a mixture solution prepared by mixing 1 part of the organic metal compound represented by the above formula (I), 9 parts of a bisazo compound represented by the following formula (IV) and 100 parts of cyclohexanone was dispersed by the use of a ball mill. The resulting dispersion was coated on the undercoating layer, using the draw coating method, and dried to form a charge generating layer.

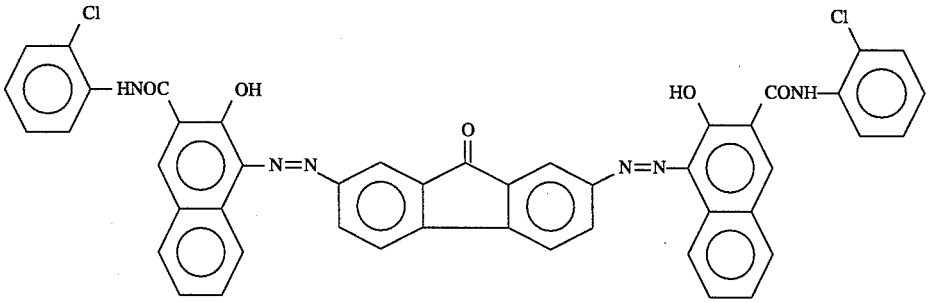

(IV)

Then, a charge transporting layer was formed in the same manner as in Example 1 to form an electrophotographic photoreceptor. For the resulting electrophotographic photoreceptor, the electrophotographic characteristics were evaluated in the same manner as in Example 1. The thus-obtained results are shown in Table 2.

COMPARATIVE EXAMPLE 2

An electrophotographic photoreceptor was prepared in the same manner as in Example 4 except that 1 part of the polyvinyl butyral resin ("BMS", manufactured by Sekisui Chemical Co., Ltd.) was substituted for the organic metal compound, and the electrophotographic characteristics were evaluated in the same manner as in Example 1. Thus-obtained results are shown in Table 2.

TABLE 2

| | Initial | | | After 1,000 Cycles | | |
|---|---|---|---|---|---|---|
| | VDDP (V) | VRP (V) | E1/2 (erg/cm$^2$) | VDDP (V) | VRP (V) | E1/2 (erg/cm$^2$) |
| Example 4 | −520 | −5 | 2.3 | −500 | −10 | 2.6 |
| Comparative Example 2 | −520 | −10 | 2.5 | −480 | −30 | 4.3 |

Because electrophotographic photoreceptors of the present invention are formed using the organic metal alkoxides or the organic metal chelate compounds as the binders, when the photoreceptors are repeatedly used under the condition of high temperature and humidity for a long time, a reduction in charging property and an increase in residual potential do not occur, and the photoreceptors exhibit excellent environmental stability.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an electrically conductive substrate having thereon at least a charge generating layer and a charge transporting layer, wherein said charge generating layer contains a charge generating material and binder having film forming properties, said binder being comprised of an organic metal alkoxide or an organic chelate compound, wherein the organic metal alkoxide or the organic metal chelate compound is: $Zr(OC_3H_7)_4$, $Zr(OC_4H_9)_4$, $Ti(OC_3H_7)_4$, $Ti(OC_4H_9)_4$, $Si(OCH_3)_4$, $Si(OC_3H_7)_4$, $Sn(OCH_3)_4$, $Sn(OC_4H_9)_4$.

2. An electrophotographic photoreceptor comprising an electrically conductive substrate having thereon at least a charge generating layer and a charge transporting layer, wherein said charge generating layer contains a charge generating material and binder having film forming properties, said binder being composed of an organic metal alkoxide or an organic metal chelate compound wherein the organic metal alkoxide or metal organic chelate compound is: $Zr(C_5H_7O_2)_4$, $(C_5H_7O_2)Zr(OC_4H_9)_3$ or $(C_3H_7O)_2Ti(C_5H_7O_2)_2$.

* * * * *

UNITED STATES PATENT AND TRADEMARK OFFICE

CERTIFICATE OF CORRECTION

PATENT NO. : 5,456,997

DATED : October 10, 1995

INVENTOR(S) : Hiroaki MORIYAMA et al

It is certified that error appears in the above-indentified patent and that said Letters Patent is hereby corrected as shown below:

Claim 1, Column 8, Line 12, after "$Sn(OCH_3)_4$," insert --or--.

Signed and Sealed this

Sixth Day of August, 1996

Bruce Lehman

*Attest:*

BRUCE LEHMAN

*Attesting Officer*

*Commissioner of Patents and Trademarks*